United States Patent [19]

Kelly, Jr. et al.

[11] 4,090,523

[45] May 23, 1978

[54] SYSTEM FOR AUTOMATICALLY FLUSHING HYDROCYCLONES USED IN DRILLING MUD TREATMENT

[75] Inventors: John Kelly, Jr., Arlington; Wilbur F. Roper, Dallas, both of Tex.

[73] Assignee: Mobil Oil Corporation, New York, N.Y.

[21] Appl. No.: 732,240

[22] Filed: Oct. 14, 1976

[51] Int. Cl.[2] ..... B08B 3/00

[52] U.S. Cl. ..... 134/18; 134/22 R; 134/56 R; 175/38; 175/66; 175/206; 210/105; 210/512 M

[58] Field of Search ..... 175/38, 66, 206; 134/18, 22 R, 22 C, 33, 56 R, 104, 113, 169 R; 209/211; 210/87, 90, 105, 512 R, 512 M

[56] References Cited

U.S. PATENT DOCUMENTS

| | | | |
|---|---|---|---|
| 2,870,990 | 1/1959 | Bergey | 175/66 |
| 2,954,871 | 10/1960 | Lummus et al. | 209/211 |
| 3,016,962 | 1/1962 | Lummus et al. | 175/66 |
| 3,025,965 | 3/1962 | Bergman et al. | 210/512 R |
| 3,766,997 | 10/1973 | Heilhecker et al. | 175/66 |
| 3,959,139 | 5/1976 | El-Hindi | 210/512 R X |

*Primary Examiner*—Richard V. Fisher

*Attorney, Agent, or Firm*—C. A. Huggett; Henry L. Ehrlich

[57] ABSTRACT

This specification discloses a system and method for flushing and cleaning a hydrocyclone used in removing drilled solids from a drilling mud circulated in the drilling of a borehole. The system is comprised of a feed pump connected via a mud conduit to the inlet of a hydrocyclone. A check valve is located in the mud conduit intermediate the feed pump and the inlet of the hydrocyclone which allows the mud to flow through the mud conduit only in the direction toward the hydrocyclone. Another conduit for flowing a cleaning liquid is connected with the mud conduit on the hydrocyclone side of the check valve. A valve responsive to a signal, pressure or electrical, is located in this other conduit intermediate the mud conduit and a supply of cleaning liquid. A means for detecting flow and transmitting a signal proportional thereto is located in the mud conduit on the hydrocyclone side of the check valve to detect the flow of mud in the mud conduit and detect the shutting down of the feed pump and to transmit a signal proportional thereto which signal effectuates the opening of the valve in the other conduit and permits the cleaning fluid to flow into and flush and clean the hydrocyclone.

9 Claims, 2 Drawing Figures

SYSTEM FOR AUTOMATICALLY FLUSHING HYDROCYCLONES USED IN DRILLING MUD TREATMENT

BACKGROUND OF THE INVENTION

This invention is related to the treatment of a liquid drilling fluid or drilling mud used in the drilling of a borehole into the earth.

In the drilling of a borehole by rotary drilling techniques a drill bit is attached to the lower end of a drill string and the drill string is rotated and lowered to form a borehole in the earth. A drilling fluid is circulated through the borehole normally down the drill string to the bottom of the borehole and thence upward through the annulus to the surface of the earth. The drilling fluid may be either liquid or gaseous but usually is liquid and is commonly referred to as a drilling mud. The drilling mud may be either water base, oil base, or an emulsion.

The circulating drilling mud cools and lubricates the drilling bit and drill string, removes earth cuttings, referred to as "drilled solids", from the borehole, forms a filter cake on the borehole wall, and controls formation pressure. In order to best perform these functions, additives are included in the drilling mud to obtain desired rheological properties. During the progress of drilling it is necessary to monitor and treat the drilling mud to maintain these desired rheological properties.

Drilled solids tend to accumulate in the drilling mud and if not removed will seriously deteriorate the rheological properties thereof. For example, as pointed out in U.S. Pat. No. 3,766,997, to Joe K. Heilhecker et al., drilled solids increase the viscosity and density of the drilling fluid, reduce the carrying capacity of the fluid, promote poor filter cake qualities, and damage drilling equipment.

Hydrocyclones are used to treat drilling muds, particularly unweighted drilling muds, to remove drilled solids therefrom. A hydrocyclone is a separator having a generally conical separation chamber with an inlet disposed generally tangentially to the side of and adjacent the base of the cone of the chamber, with an axial underflow outlet located adjacent the apex of the cone, and with an axial overflow outlet located adjacent the base of the cone. The drilling mud is fed under pressure into the inlet and the pressure energy is converted into centrifugal force. The developed centrifugal forces multiply the settling velocities of the suspended solids, driving the larger and heavier particles outwardly toward the conical wall and downwardly into a centrifugally accelerating spiral along the wall to the underflow outlet, the solids discharge point at the apex of the cone. The liquid phase of the drilling mud, carrying the smaller and lighter drilled solids, moves inwardly and upwardly as a spiraling vortex to the axial overflow outlet adjacent the base of the cone.

In U.S. Pat. No. 3,025,965, to William E. Bergman et al., there is disclosed a hydraulic cyclone separation system for separating a portion of the larger and heavier solids which are temporarily suspended in a liquid rotary well drilling mud from the remainder of the mud. It was there noted as follows: In the prior art of hydraulic cyclone separation of solids from well drilling muds considerable difficulty has been experienced. The mud is too concentrated, and we have found it needs dilution with water. Upon shutdown of the system between periods of use, the mud settles into a solid cake on the walls of the mud pump and mud lines, making it impossible to start up the unit until sufficient parts are disassembled and cleaned out to permit the mud pump to operate again. The walls of the hydraulic cyclone chamber are rapidly worn away by abrasion of the heavy undiluted mud containing abrasive solids and clays without dilution water. The invention of Bergman et al. is directed to solving these problems by providing a plurality of pumps of which at least one pumps mud and at least another pumps only water. Dilution water is run into the mud going to the hydrocyclone to reduce the abrasion thereof and the hydrocyclone cone is made out of Tungsten carbide to make it resistant to abrasion. Water is pumped from the water pump through the feed pump and lines before a shutdown to eliminate the deposit of solid mud therein.

In the before-mentioned Heilhecker et al. patent there is disclosed a system for treating a drilling fluid being circulated in a well and containing a fine-sized particulate weighting material and drilled solids wherein the drilling fluid is passed through a first vibrating screen which removes a portion of the drilled solids and then through centrifugal separating means to separate the drilling fluid into a low density effluent and into a high density underflow slurry. The effluent is returned to the drilling fluid system and the underflow slurry is further processed through a second vibrating screen. The second vibrating screen is substantially finer than the first vibrating screen and functions to remove additional drilled solids. Material passing through the second vibrating screen which includes most of the weighting material and the underflow slurry is returned to the drilling fluid system.

SUMMARY OF THE INVENTION

This invention is directed to a system for automatically flushing a hydrocyclone used for treating a drilling mud that is circulated in a well to remove drilled solids therefrom upon shutdown of the hydrocyclone. The hydrocyclone is comprised of a separator having a generally conical separation chamber with an inlet disposed generally tangentially to the side of and adjacent to the base of the cone of the chamber, an axial underflow outlet adjacent the apex of the cone, and an axial overflow outlet adjacent the base of the cone. The system is comprised of a first conduit that connects with the inlet of the hydrocyclone and connects with the outlet of a pump adapted for conducting the flow of drilling mud to the hydrocyclone. A check valve is located in the first conduit intermediate the pump and the inlet of the hydrocyclone which check valve permits flow of mud through the conduit only in the direction of the hydrocyclone. A second conduit connects with the first conduit downstream of the check valve and is adapted at the other end for connecting with a source of cleaning fluid. A valve adapted to be operated by a relay signal is located in the second conduit to control the flow of fluid therethrough. A means to detect flow and transmit a signal proportional thereto communicates with the first conduit downstream of the check valve and is connected with a means for transmitting a relay signal for a preselected length of time which in turn is connected with the valve adapted to be operated by a relay signal.

DESCRIPTION OF THE PREFERRED EMBODIMENTS

Figure 1:
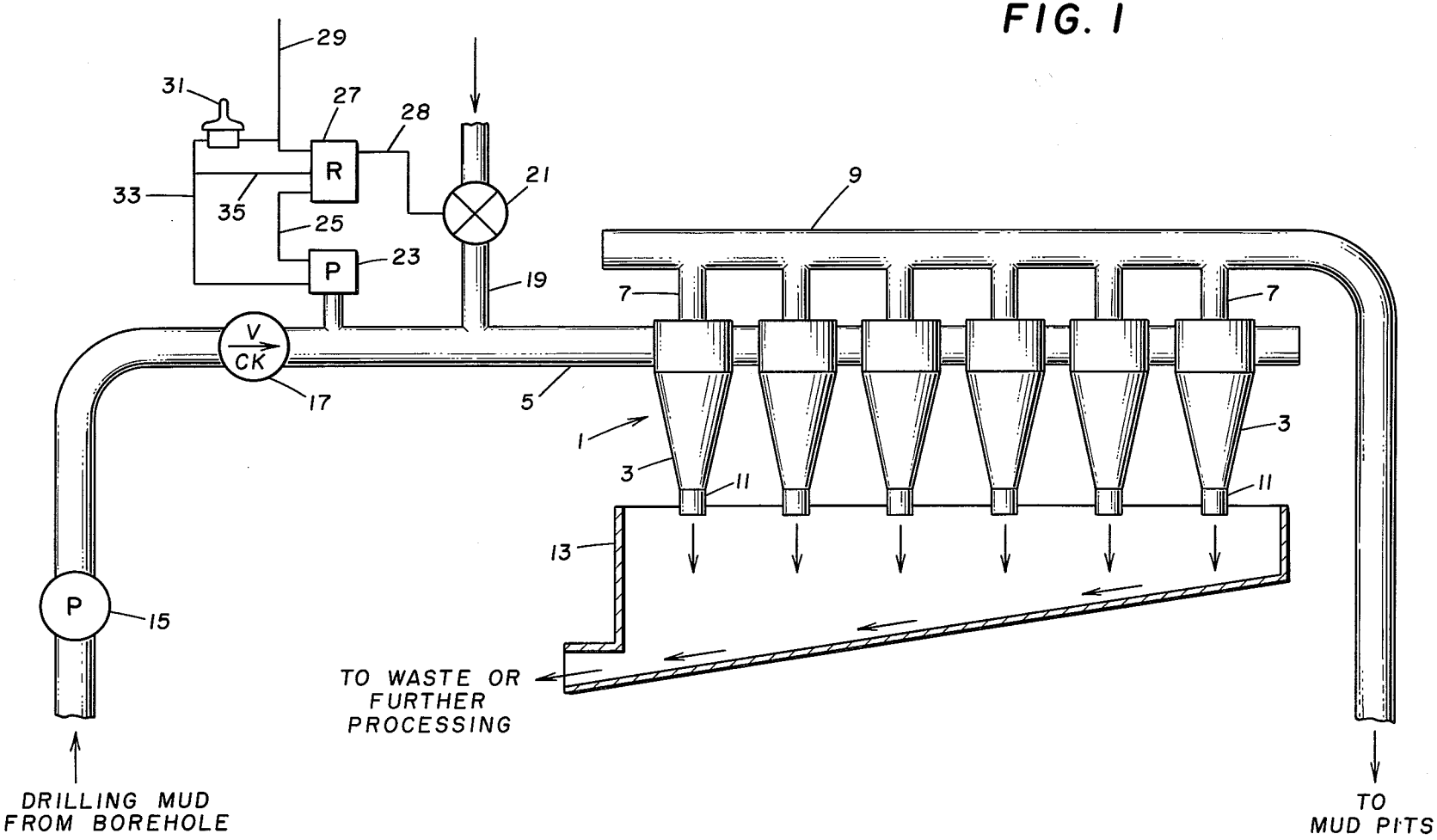
FIG. 1 is a schematic view illustrating a system of this invention for flushing a hydrocyclone.

This invention is directed to a system and method for treating a drilling mud with a hydrocyclone to remove drilled solids therefrom. More particularly, this invention is directed to a system and method for automatically flushing and cleaning the hydrocyclone of drilling mud upon shutdown of the feed pump that circulates drilling mud through the hydrocylones for treatment.

In treating a drilling mud to remove drilled solids therefrom, it is common to use a plurality of hydrocyclones, "bank of hydrocyclones", rather than a single hydrocyclone in order to better handle the large volume of mud involved. The inlets of each of the hydrocyclones of the bank are normally connected in parallel into a single inlet conduit or manifold such that each portion of the drilling mud treated is flowed through a single hydrocyclone. The axial overflow outlets adjacent the base of the cones of the individual hydrocyclones are also normally connected in parallel into a single outlet conduit or manifold, such that the liquid discharge of the overflow outlets of the hydrocyclones flows into the outlet conduit where it is then flowed to the mud pit. The axial underflow of each hydrocyclone normally flows into a trough or tank from which it may be flowed to waste or may be further screened or processed as desired.

In the treating of the mud the feed pump is normally activated and drilling mud is treated by the hydrocyclones generally during the time that the mud pumps are activated to circulate drilling mud through the borehole, and shut down generally during the time that the mud pumps are shut down. Shutdowns of the mud pump are common in the drilling of a borehole. For example, each time a "trip" is made, such as when the drill string is pulled to change a bit, the mud pumps are shut down for a substantial length of time, sometimes for many hours depending upon the depth of the borehole. It is quite common upon resuming drilling and mud treatment to find that one or more of the hydrocyclones in a bank of hydrocyclones do not flow any substantial amount of mud through the underflow outlet. It is considered that this occurs because a portion of the mud tends to cake and solidify in the hydrocyclones during the time of the shutdown, and when the mud treatment is again begun this caked and solidified mud blocks the underflow outlets of the hydrocyclones. The underflow outlets of the hydrocyclones are normally adjustable in size but in many instances are on the order of one-half inch in diameter. In normal practice upon reactivating the feed pump the driller, upon observing that any of the hydrocyclones are not discharging the usual underflow, dispatches a man with a rod to clean the underflow passages of the affected hydrocyclone. During the lapsed time before the hydrocyclones are operating efficiently drilled solids in the untreated drilling mud bypass the hydrocyclones and flow back into the mud pit, thereby contaminating the treated drilling mud being recirculated into the borehole.

With reference to FIG. 1 there is shown a bank of hydrocyclones 1 made up of six individual hydrocyclones identified as 3. The inlets (not shown) of the hydrocyclones 3 are connected with the mud conduit 5, and the axial overflow outlets 7 of the hydrocyclones are connected with the overflow conduit 9 which leads to the mud pits (not shown). The axial underflow outlet 11 of the hydrocyclones 3 feed the heavier drilled solids discharge of the hydrocyclone into a trough 13 from which the drilled solids discharge is flowed to waste or to a location for further processing.

Figure 2:
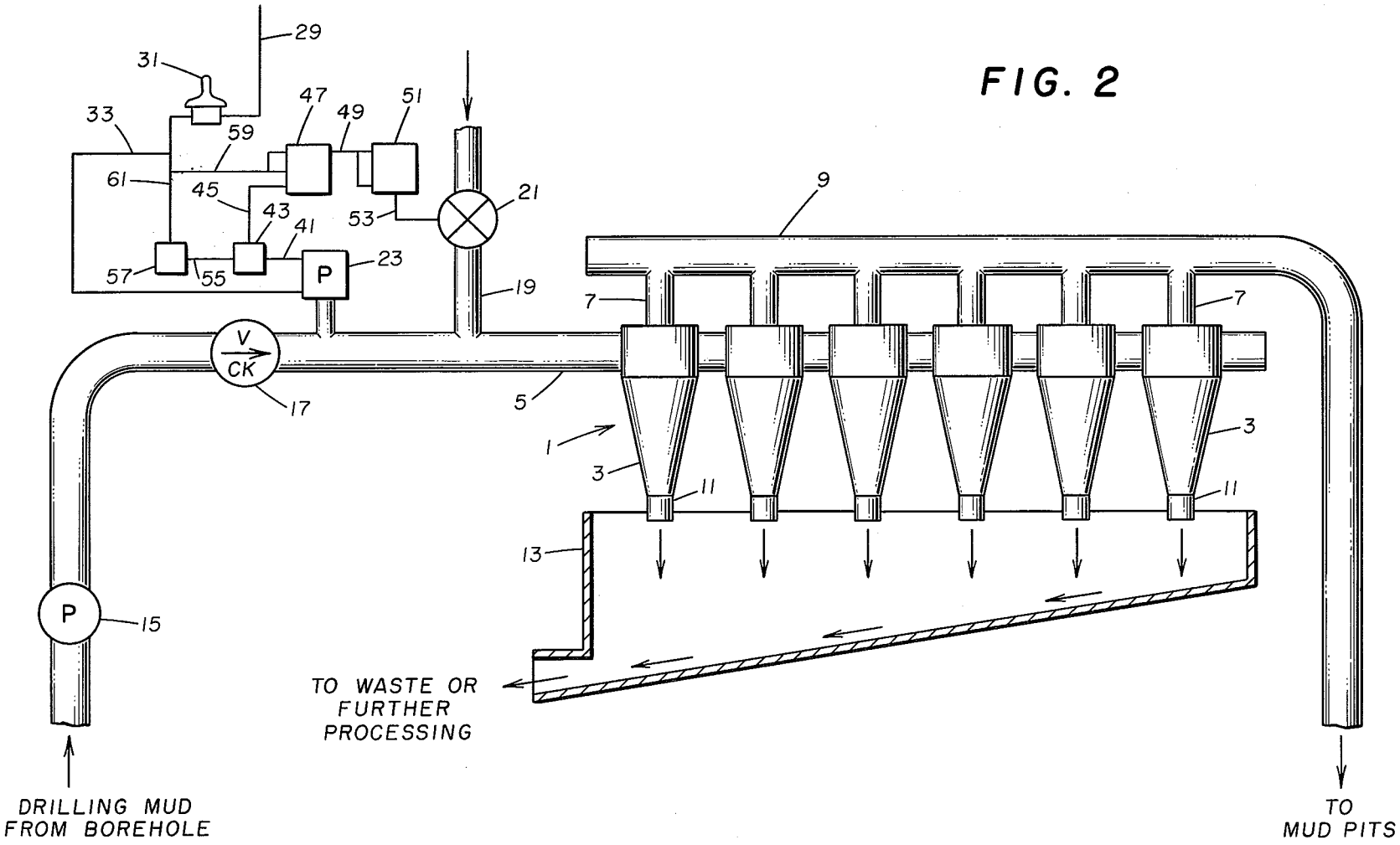
FIG. 2 is a schematic view illustrating a preferred system of this invention for flushing a hydrocyclone.

In the practive of this invention at least a portion of the drilling mud from the active mud system of a borehole being drilled (not shown) is flowed via a feed pump 15 and mud conduit 5 into the bank of hydrocyclones 1 for removing the drilled solids therefrom. Normally the drilling mud will have been passed through screens to remove large drilled solids therefrom prior to being flowed to the hydrocyclones. The drilling mud flows through the mud conduit 5 into the inlets (not shown) of the individual hydrocyclones 3, which inlets are disposed generally tangentially to the side of and adjacent to the base of the cone of the chamber of the hydrocyclone, which chamber has essentially the same shape as that shown for the hydrocyclones 3. In FIG. 1 and FIG. 2 discussed later the inlets are on the back side of the hydrocyclones 3 and thus are not shown. The pressure energy of the drilling mud flowing into each hydrocyclone is converted into centrifugal force by being tangentially fed into the conical vessel. The larger drilled solids are driven outwardly toward the conical wall and downwardly into a centrifugally accelerating spiral along the wall to the underflow outlet 11 which is an axial outlet located at the lower part of the hydrocyclone at the base of the cone. The separated drilled solids along with some mud are there discharged into the trough 13 for disposal or further processing. The drilling fluid with the larger drilled solids removed therefrom being a lighter liquid phase moves in the hydrocyclone inwardly and upwardly as a spiraling vortex to the axial overflow outlet 7 located adjacent the base of the cone. The drilling fluid flows from the overflow outlet 7 into the overflow conduit 9 and thence into the mud pits (not shown) for reuse as drilling mud in the drilling of the borehole.

In accordance with this invention a check valve 17 is located in the mud conduit 5 intermediate the feed pump 15 and the bank of hydrocyclones 1. The check valve 17 is designed to permit the flow of the drilling mud through the mud conduit 5 from the feed pump 15 to the bank of hydrocyclones 1 but prevents reverse flow thereof. A second conduit 19 is provided and communicates with the mud conduit 5 downstream of the check valve 17. The conduit 19 connects with a source of liquid under a desired pressure, which liquid is utilized for cleaning the hydrocyclones 3. The liquid is normally water when a water-base drilling mud is in use and diesel oil when an oil-base drilling mud is in use. Other liquids than water and diesel oil could be used for cleaning the hydrocyclones and, in fact, better cleaning agents are probably available, but water and diesel oil are preferred because of the ready availability at the borehole site and relative low cost thereof. The liquid for cleaning the hydrocyclones is flowed into the hydrocyclones at a pressure sufficiently high to cause the liquid to spiral downwardly along the wall and clean the wall of the hydrocyclones and then exit through the underflow outlet and insufficient to cause the liquid to move inwardly and upwardly as a spiraling vortex and flow into the overflow conduit 9. If too high a pressure is used when injecting the cleaning liquid into the hydrocyclone the latter would happen with the result that the drilling mud in the drilling mud pits would be diluted by the cleaning liquid.

A valve 21 which may be operated by a signal, such as a pneumatic or electrical signal, is installed in the conduit 19 for controlling the flow of liquid therethrough and into the bank of hydrocyclones 1. A means 23 to detect flow and transmit a signal proportional thereto is located to communicate with the mud conduit 5 downstream of the check valve 17, which means 23 detects the flow within the conduit 5 and transmits a signal proportional thereto. The means 23 to detect flow and transmit a signal proportional thereto may be, for example, a magnetic flow meter, vane type flow meter, or any other flow-indicating device. Pressure sensing devices may also be used inasmuch as they give an indication of the pressure of the mud in the conduit and thus an indication of the flow of the mud therethrough. For simplicity of description reference will hereafter be made to a pressure transmitter 23 to sense pressure and transmit a signal proportional thereto and it is to be understood that the term "pressure transmitter" is used to include flow detection means as well. The pressure transmitter 23 transmits a signal via line 25 to a time delay relay 27 which in response thereto transmits a signal, electrical or pneumatic, for a preselected length of time through a line 28 to the valve 21 to open the valve and allow cleaning liquid to flow through the valve and conduit 19 and into the bank of hydrocyclones 1. As an example wherein such a signal is a pneumatic signal there is run a line 29 which connects a source of pressurized air (not shown) with the time delay relay 27 and with an air pressure regulator 31. Air from the pressure regulator 31 is supplied via a line 33 to the pressure transmitter 23 and via a line 35 to the time delay relay 27. The pressure transmitter 23 upon sensing a drop in pressure in the conduit 5 sends a pneumatic signal via line 25 to the time delay relay 27 which then lets air from the air source flow through the line 28 to operate the valve 21.

A preferred embodiment is described with reference to FIG. 2 where, as was shown in FIG. 1, there is seen the pressure transmitter 23 and the valve 21 located in the conduit 19 connecting with the mud conduit 5. The pressure transmitter signal from the pressure transmitter 23 is transmitted via line 41 through a selector switch 43 and thence via the line 45 to a limit switch 47. When the feed pump 15 is shut off the pressure in the conduit 5 drops to zero or very nearly zero. The signal produced by the pressure transmitter 23 is then at the lower limit of the signal range. When this low signal reaches the limit switch 47 and is less than the lower limit setting of the limit switch 47, then the limit switch 47 transmits a proper signal through line 49 to a time delay relay 51 which in turn transmits power through line 53 to the valve 21 to open the valve and allow cleaning liquid to flow through the valve and conduit 19 and into the bank of hydrocyclones. At the end of a set flushing time period the time delay relay 51 shuts off the power to the valve 21 which closes and shuts off the flow of cleaning liquid through the conduit 19. Both the limit switch 47 and the time delay relay 51 hold their condition at this point until reset by application to the limit switch 47 of a signal greater than the upper limit setting in the limit switch 47. Normally this signal comes from the pressure transmitter 23 after the feed pump is restarted and the pressure in conduit 5 reaches normal operating level. The system is thus reset to flush again when the pump is shut off.

In order to check out the operation of the flushing system and to provide more complete control over the flushing system it is highly desirable to provide a manual mode of operation in addition to the normal automatic mode. The selector switch 43 is a three-way switch which either connects line 45 to line 41 for automatic operation by the signal from the transmitter 23 or connects line 45 to line 55 for manual operation by a signal from a manual switch 57. The manual switch 57 in the flush position supplies a lower limit signal to the limit switch 47 which in turn starts the flushing cycle. The manual switch 57 in the reset position supplies a signal above the upper limit on the limit switch 47 and resets both the limit 47 and the time delay relay 51 for the next flushing cycle.

It is not uncommon for the feed pump 15 to lose prime and pump only a small portion of the mud normally pumped at full flow. In such cases the pressure in the mud conduit 5 is much lower than the pressure during normal full flow. For example, the pressure in the mud conduit 5 on loss of prime might typically be in the range of one-fourth to one-third the normal operating pressure. It is highly desirable that this lower pressure should not start the flushing action. Therefore, it is advantageous to have a limit on the low pressure which can cause the system to flush. The loss of prime is usually corrected by stopping the pump and restarting after suitable adjustments are made. This usually takes only a short time and there would be no need to flush this system although no particular harm would result if the flush cycle did operate. To correct the problem and restore the system to normal operation it may be necessary to start and stop the pump several times in a very short period of time. During such problem periods it would be advantageous to use the selector switch 43 to place the system on manual mode of operation with the manual switch 57 in reset position. When the feed pump 15 is back in normal operation and pressure is normal, the flushing system may be placed back in automatic mode by operating the selector switch 43.

After a normal shutdown period for making a trip the feed pump 15 may not provide full flow and normal pressure on start up. Such a "false start" would not reset the flush system if the upper limit setting on the limit switch 47 is just slightly less than that corresponding to normal operating pressure in the conduit 5. This feature avoids the unnecessary and undesirable flushing of the system when the pump is shut off after false starts.

In accordance with another preferred embodiment, pneumatic power is employed to form a fail-safe system for flushing the hydrocyclones upon shutdown of the pump 15. Pneumatic power is preferred over electrical power because of the intrinsic safety of the pneumatic power in an environment which at times can be classified as hazardous for electrical systems. Electrical equipment could be used but would likely be required to be of explosion-proof construction, adding to the complexity and cost of the system. Air under pressure is normally available at drilling rigs used for drilling boreholes and the pressurized air is applied via line 29 to an air pressure regulator 31. Air from the air pressure regulator 31 is supplied via line 33 to the pressure transmitter 23, via a line 59 to the limit switch 47 which serves as a pneumatic switching valve, and via a line 61 to the manual switch 57 which serves as a manually operated switching valve. The limit switch 47 transmits the air via a line 49 to the pneumatic time delay relay 51 which in turn transmits the air via a line 53 to the valve 21. The valve 21 is adapted to remain closed except when air pressure is applied to a pneumatic actuator (not shown)

via the line 53. This prevents the accidental flowing of liquid through valve 21 into the mud conduit 5 should the source of air pressure fail. Such an accidental flowing of liquid into the mud conduit 5 while drilling mud is being flowed into the hydrocyclone for treatment would result in diluting the drilling mud being returned to the active mud system. Upon shutdown of the feed pump 15, the pressure transmitter 23 senses the drop in pressure in the conduit 5 and sends a pneumatic signal via line 41 through the selector switch 43 in position for automatic mode, thence via line 45 to the penumatic limit switch 47. When the pneumatic signal drops to a value less than the lower limit setting on the limit switch 47, then the limit switch 47 opens the air to flow via line 49 to the pneumatic time delay relay 51 and almost simultaneously via line 53 to the pneumatic valve 21. The air pressure starts the timing by time delay relay 51 and opens the valve 21 to allow cleaning liquid to flow into the mud conduit 5 and out through the hydrocyclones 3 to waste. The check valve 17 prevents the liquid from backflowing through the conduit 5 and the feed pump into the active drilling mud system. At the end of the timing period the time delay relay 51 shuts off the air to the valve 21 and exhausts the air from line 53 and valve 21 so that valve 21 closes and shuts off the flow of cleaning liquid. The limit switch 47 which is a switching valve and the time delay relay 51 hold these positions until reset. The reset is accomplished automatically by the application of a pressure signal via line 45 to the limit switch 47. When the value of the pneumatic signal rises above the upper limit setting in the limit switch 47, the limit switch shuts off the air pressure to and exhausts the air pressure from line 49 and the time delay relay 51. Exhausting the air from the time delay relay 51 resets the timing mechanism and switches the valve to connect line 49 to line 53. The flushing mechanism to now reset and ready to operate when the pressure signal via line 45 drops below the lower limit setting of the limit switch 47. In the automatic mode the selector switch 43 which serves as a selector valve is positioned so that the pressure signal comes via line 41 from the pressure transmitter 23 as in the above description. When the selector switch 43 is positioned in the manual mode the pressure signal comes via line 55 from the manual switch 57 which is a manually operated valve. In the reset position of the manual switch 57 and the high pressure signal comes from the air supply via line 61. In the flush position the manual switch 57 exhausts the air from lines 55 and 45 and from the limit switch 47 to provide a low level signal which starts the flushing cycle.

A pneumatically operated valve suitable for use as valve 21 is a Jamesbury 1" A2236TT valve with C50S actuator available from Jamesbury Corporation, 649 Lincoln St., Worcester, Mass. 01605.

A pressure transmiter suitable for use as the pressure transmitter 23 is a Nullmatic Model 19 pressure transmitter availble from Moore Products Company, Spring House, Penn. 19477.

A pneumatic timing relay switch for use as the timing delay relay 51 is a Model PT-31 Agastat Pneumatic Timing Valve available from Amerace Corporation, Control Products Division, 2330 Vauxhall Road, Union, N.J. 07083.

A pneumatic switching valve suitable for use as the limit switch 47 is a Model 73 Snap Acting Three-Way Pneumatic Switching Valve available from Fairchild Industrial Products Division, 1501 Fairchild Drive, Winston-Salem, N.C. 27105.

A selector valve suitable for use as the selector switch 43 and the manual switch 57 (manual operating valve) is a Circle Seal Three-Way Plug Valve, Type 9359, available from Circle Seal Products Company, P. O. Box 3666, Anaheim, Calif. 92803.

A pressure regulator suitable for use as the pressure regulator 31 is a Fairchild Model 64 Industrial Regulator available from Fairchild Industrial Products Division, 1501 Fairchild Drive, Winston-Salem, N.C. 27105.

We claim:

1. In a method of treating a drilling mud to remove drilled solids therefrom wherein the drilling mud is flowed through a first conduit and into a hydrocyclone and there treated to remove the drilled solids, the method of automatically flushing the hydrocyclone upon stopping flow of mud thereto comprising:

(a) installing a check valve in said first conduit to permit flow of mud through said first conduit only in the direction toward said hydrocyclone;

(b) locating a second conduit to communicate with said first conduit downstream of said check valve;

(c) sensing the flow of mud through said first conduit downstream of said check valve to detect the stopping of flow of mud through said first conduit; and (d) generating a signal in response to said stopping of flow of mud through said first conduit, which signal activates for a preselected time a flow of cleaning liquid through said second conduit and into said first conduit and thence into said hydrocyclone, whereby said hydrocyclone is automatically flushed upon the stopping of flow of mud through said first conduit into said hydrocyclone.

2. A system for automatically flushing a hydrocyclone used for treating a drilling mud to remove drilled solids therefrom, comprising in combination:

(a) a hydrocyclone separator having a generally conical separation chamber with an inlet disposed generally tangentially to the side of and adjacent to the base of said cone of said chamber, an axial underflow outlet adjacent the apex of said cone, and an axial overflow outlet adjacent the base of said cone;

(b) an inlet conduit connecting with said inlet of said separator;

(c) a pump connecting with said inlet conduit for flowing drilling mud into said separator;

(d) a check valve located in said inlet conduit intermediate said pump and said inlet of said separator to permit flow through said inlet conduit only in the direction toward said inlet of said separator;

(e) another conduit connecting with said inlet conduit downstream of said check valve for flowing cleaning liquid into said inlet conduit;

(f) a valve operated by a received signal located in said another conduit to control the flow of cleaning liquid therethrough;

(g) a means to detect flow of drilling mud in said inlet conduit and transmit a signal proportional thereto located downstream of said check valve;

(h) a selector switch connecting with said means to detect flow of drilling mud and transmit a signal;

(i) a limit switch connecting with said selector switch; and (j) a means for transmitting a relay signal for a preselected length of time connecting with said limit switch and connecting with said valve operated by a received signal, whereby said valve operated by a received signal may be opened for said preselected length of time for flowing cleaning liquid into said inlet conduit to automatically flush said hydrocyclone.

3. The system of claim 2 wherein said selector switch is a three-way switch and further comprising in combination:

a manual switch for selectively supplying a lower limit signal or a higher upper limit signal to said limit switch, said manual switch being connected with said selector switch and with said limit switch.

4. The system of claim 3 wherein said element (g) is a means to sense pressure of the drilling mud flow and transmit a signal proportional thereto.

5. The system of claim 4 wherein said system for automatically flushing a hydrocyclone is a fail-safe pneumatic system and wherein:

said valve of element (f) is a pneumatic valve; said means of element (g) transmits a pneumatic signal; said selector switch is a selector valve; said limit switch is a pneumatic switching valve; and said manual switch is a manually operated switching valve.

6. In a method for treating a drilling mud that is circulated in a well to remove drilled solids therefrom wherein there is employed a hydrocyclone that is comprised of a separator having a generally conical separation chamber with an inlet disposed generally tangentially to the side of and adjacent to the base of the cone of the chamber, an axial underflow outlet adjacent the apex of the cone, and an axial overflow outlet adjacent the base of the cone, and wherein a first conduit connects with the inlet of the hydrocyclone and communicates with the drilling mud to be treated and wherein a pump is located in the first conduit to feed drilling mud to the hydrocyclone, the improvement comprising:

(a) installing a check valve in said first conduit intermediate said pump and said inlet of said hydrocyclone to permit flow of mud through said first conduit only in the direction from said pump toward said hydrocyclone;

(b) locating a second conduit to communicate with said first conduit intermediate said check valve and said inlet of said hydrocyclone, said second conduit communicating with a means supplying cleaning fluid;

(c) locating a valve operated by a relay signal in said second conduit to control the flow of liquids therethrough;

(d) installing a time delay relay that will receive signals and transmit a relay signal in response to said received signal of an amplitude outside of a preselected amplitude range, said time delay relay being connected with said valve adapted to be operated by a relay signal; and (e) detecting the flow of drilling mud in said first conduit downstream of said check valve and transmitting a signal proportional thereto to said time delay relay, whereby, in response to a transmitted relay signal, cleaning liquid is flowed into said first conduit to automatically flush said hydrocyclone.

7. The method of claim 6 wherein step (e) comprises, sensing the pressure of the drilling mud flow in said first conduit downstream of said check valve and transmitting a signal proportional thereto to said time delay relay.

8. A system for automatically flushing a hydrocyclone used for removing drilled solids from a drilling mud circulated in a well upon shutdown of the hydrocyclone wherein said hydrocyclone is comprised of a separator having a generally conical separation chamber with an inlet disposed generally tangentially to the side of and adjacent to the base of said cone of said chamber, an axial underflow outlet adjacent the apex of said cone, and an axial overflow outlet adjacent the base of said cone, comprising:

(a) a first conduit connecting to said inlet of said hydrocyclone for conducting the flow of drilling mud thereto;

(b) a check valve located in said first conduit to permit flow through said first conduit in the direction toward said hydrocyclone and block flow in the reverse direction;

(c) a second conduit connecting with said first conduit downstream of said check valve for flowing cleaning liquid into said first conduit;

(d) a valve operated by a relay signal, said valve being located in said second conduit to control the flow of liquid therethrough;

(e) a means to detect flow of mud and transmit a signal proportional thereto communicating with said first conduit downstream of said check valve; and (f) a means for transmitting a relay signal for a preselected length of time in response to a received signal from said means to detect flow of mud and transmit a signal proportional thereto, connecting with said valve operated by a relay signal and connecting with said means to detect flow of mud and transmit a signal proportional thereto, whereby said valve operated by a relay signal may be opened for said preselected length of time for flowing cleaning liquid into said first conduit to said inlet to automatically flush said hydrocyclone.

9. A system for automatically flushing a hydrocyclone used for removing drilled solids from a drilling mud circulated in a well upon shutdown of the hydrocyclone wherein said hydrocyclone is comprised of a separator having a generally conical separation chamber with an inlet disposed generally tangentially to the side of and adjacent to the base of said cone of said chamber, an axial underflow outlet adjacent the apex of said cone, and an axial overflow outlet adjacent the base of said cone, comprising:

(a) a first conduit connecting to said inlet of said hydrocyclone for conducting the flow of drilling mud thereto;

(b) a pump for supplying drilling mud connecting with said first conduit;

(c) a check valve located in said first conduit intermediate said pump and said inlet of said hydrocyclone to permit flow through said first conduit in the direction from said pump to said hydrocyclone and block flow in the reverse direction;

(d) a second conduit connecting with said first conduit downstream of said check valve for conducting the flow of cleaning liquid into said first conduit;

(e) a valve operated by a relay signal, said valve being located in said second conduit to control the flow of liquid therethrough;

(f) a means to detect flow of drilling mud and transmit a signal proportional thereto communicating with said first conduit downstream of said check valve; and (g) a means for transmitting a relay signal for a preselected length of time in response to a received signal from said means to detect flow and transmit a signal proportional thereto, connecting with said valve operated by a relay signal and connecting with said means to detect flow and transmit a signal proportional thereto, whereby said valve operated by a relay signal may be opened for said preselected length of time for flowing cleaning liquid into said first conduit to said inlet to automatically flush said hydrocyclone.

* * * * *